US006223928B1

(12) United States Patent
Sheran et al.

(10) Patent No.: US 6,223,928 B1
(45) Date of Patent: May 1, 2001

(54) INTERLOCKING CYLINDER

(76) Inventors: Alan O. Sheran; Nicki L. Sheran, both of 3104 Ybor St., Tampa, FL (US) 33605

( * ) Notice: Subject to any disclaimer, the term of this patent is extended or adjusted under 35 U.S.C. 154(b) by 0 days.

(21) Appl. No.: 09/016,599

(22) Filed: Jan. 30, 1998

Related U.S. Application Data

(60) Provisional application No. 60/036,872, filed on Feb. 4, 1997.

(51) Int. Cl.[7] ..... B65D 3/28

(52) U.S. Cl. ..... 220/495.11; 220/739; 220/475

(58) Field of Search ..... 220/738, 739, 220/495.08, 495.11, 475

(56) References Cited

U.S. PATENT DOCUMENTS 3,498,268 * 3/1970 Sleith et al. ..... 220/603
4,457,483 * 7/1984 Gagne ..... 248/97
4,665,680 * 5/1987 Prader ..... 53/411
4,666,324 * 5/1987 Oses ..... 220/603
4,846,394 * 7/1989 Swanson ..... 229/415
5,056,679 * 10/1991 Lonczak ..... 220/404
5,105,972 * 4/1992 Waterston et al. ..... 220/603
5,169,025 * 12/1992 Guo ..... 220/739
5,186,350 * 2/1993 McBride ..... 220/739
5,372,269 * 12/1994 Sutton et al. ..... 220/404
5,390,804 * 2/1995 Beggins ..... 220/739
5,419,452 * 5/1995 Mueller et al. ..... 220/404
5,425,497 * 6/1995 Sorensen ..... 220/739
5,454,484 * 10/1995 Chelossi ..... 220/738
5,489,043 * 2/1996 Newman ..... 220/603
5,746,372 * 5/1998 Spence ..... 220/738

* cited by examiner

*Primary Examiner*—Joseph M. Moy

(57) ABSTRACT

The Interlocking Cylinder is formed from weather impervious flexible sheet material which is designed to lock to itself without the means of additional parts, pieces or adhesives. It has a multitude of uses including but not limited to: use as a splash guard for mixing chemicals, plant protectors, bag support for sand bagging operations, bag support for trash bags and an insulated cylinder to hold ice and beverages. It is quickly and easily assembled and disassembled for repeated usage.

4 Claims, 6 Drawing Sheets

INTERLOCKING CYLINDER

This application claims benefit of provisional no. 60/036,872 filed Feb. 4, 1997.

BACKGROUND OF THE INVENTION

1. Background-Field of the Invention

A. This invention relates in general to use as a tool to guard against splash and splatter caused by the drill mixing of chemicals, and B. this invention also relates to a guard to protect plants from adverse weather conditions, additionally C. this invention can be used as a tool to support bags while filling, and particularly to supporting sand bags while filling.

2. Background-Prior Art

A. Contractors who use a drill as a means to mix concrete, paint or other chemicals, are constantly faced with the very high probability of splashing or splattering the contents of the bucket onto their shoes, clothing and customers floors, driveways, etc. Even with the use of a drop cloth, the drill has the means of causing a great deal of damage and lost time in clean up efforts.

No prior art has been found relating to a guard to prevent this from happening.

The present invention would be very useful to these contractors or even homeowners who are faced with this problem. For a splash guard, the present invention can be used with or without an inserted plastic bag. The present invention can be transported easily in a flat condition using little space among the contractors' equipment. The use of this invention will protect the workman's shoes, clothing and other surfaces from unwanted splatters and will also hold the drill in an upright position when not in use. An additional advantage is that the cylinder can be removed from around the bucket either by unfastening the cylinder or simply lifting it over the bucket, eliminating the need to lift a heavy bucket from a container. B. In regard to the second use, that as a guard to protect plants from adverse weather conditions, many gardeners cut both ends from cans and save the rusty cans from year to year in order to protect their fragile plants and seedlings from adverse weather conditions. This is only marginally successful at best, as the cans, while acting as a wind shield, can reflect too much heat and sun and actually burn the seedlings and can also damage the plant during removal if the plant has grown beyond the edges of the can.

U.S. Pat. No. 5,347,750 invented by Thomas Mills, and dated Sep. 20, 1994, is for a reusable plant protector. This device requires the use of additional fastening devices and would be very time consuming if many applications were to be attempted in an emergency weather situation. The circumference of this device is not adjustable and has no means of attaching a temporary lid.

The present invention can cheaply, quickly and easily be used as plant protectors. These can be unfastened from around the plant without causing damage, and can be used with an addition of an optional sleeve of foam insulating material around the inside perimeter of the cylinder. Lids can be attached securely to prevent frost or hail damage. Storage problems are eliminated as the present invention can store flat and even in large quantities take very little space. C. In the event of floods, hurricanes or other natural disasters, sandbagging efforts are greatly needed. In some cities heavy equipment and mechanized sandbagging operations are available, however too often we see lines of volunteers, totally exhausted, attempting to beat the ensuing disaster. Each of these scenes include pictures of one individual with a shovel and one holding open a sand bag.

There has been no prior art for individual sandbagging operations found.

A further use for the present invention is as a tool to be used during sand bagging operations. These can be opened positively flat for ease in shipping for mass distribution in emergency situations. When manipulated into a cylinder, they can be used to support the sand bags while filling, thereby effectively doubling the volunteer effort when speed is essential, or can be used by an individual alone by eliminating the need for a second person to hold open the sand bag. Frequently, much needed help is simply not available.

With the advent of the plastic bags came the difficulty in filling them without the collapse of the bag. Bags are available in various sizes and do not always fit standard trash containers. Also standard trash containers have no means of securing the bags to hold them open without the attachment of tape, ties or rope which causes tearing and extra time to remove them from the container. Standard trash containers also have the disadvantage of a fixed shape causing problems with storage, warehousing, shipping and transportation by the end user. It can be next to impossible to transport a trash container home from the store in a small car. There is also a need for semi-permanent fixtures totally impervious to the elements for outdoor use.

The trash bag support sleeve, U.S. Pat. No. 4,979,547, invented by L. Jeanne Hoerner, dated Dec. 25, 1990, is the closest known prior art to the present invention and utilizes a collapsible sleeve with narrow slits to retain and hold the bag to the sleeve while filling. As this device employs a water repellant adhesive and a water resistant coating on the inside and outside, it implies that it is of a temporary, disposable nature and not for semi-permanent use out doors. It also only opens by unfolding and does not lock into place allowing for the possibility of collapse if bumped during use. It also has an elongated design which causes difficulty and wasted additional movement in filling. It is one size and not adjustable to fit a variety of size bags.

U.S. Pat. No. 4,457,483, invented by Laureat Gagne, dated Jul. 3, 1984, is for a collapsible support for garbage bags using a cylinder that fastens to itself by means of knobs to be punched through holes in the opposing edge. The bags are held open by means of upward pointing finger tabs and rely on the pressure of the tabs to secure the bag while filling. While the fastening system using knobs and holes may be secure when the cylinder is empty, the additional pressure created by a heavily filled bag can release the knob fasteners by means of inside pressure upon the circumference of the cylinder. This device is not adjustable to accommodate various size bags.

The above referenced patents achieve, to a degree, solutions to some of the problems. However, the manufacture of the present invention incorporates a means to positively lock the cylinder open during use, to collapse it and to secure the bags to it without the necessity of any additional parts, pieces or adhesive. The present invention is adjustable to fit more than one size of bag and is of a material impervious to the weather, as a preferred embodiment, therefore can be used year after year. It can be anchored for semi permanent use out doors by assembling around a post before inserting and attaching the bag, thereby adding a dimension of value for use in special events when additional trash containers are needed temporarily. The optional addition of a weighted device allows the cylinder to be used when posts are not available and wind is a factor.

DRAWING FIGURES

REFERENCE NUMERALS USED IN DRAWINGS

Figure 1:
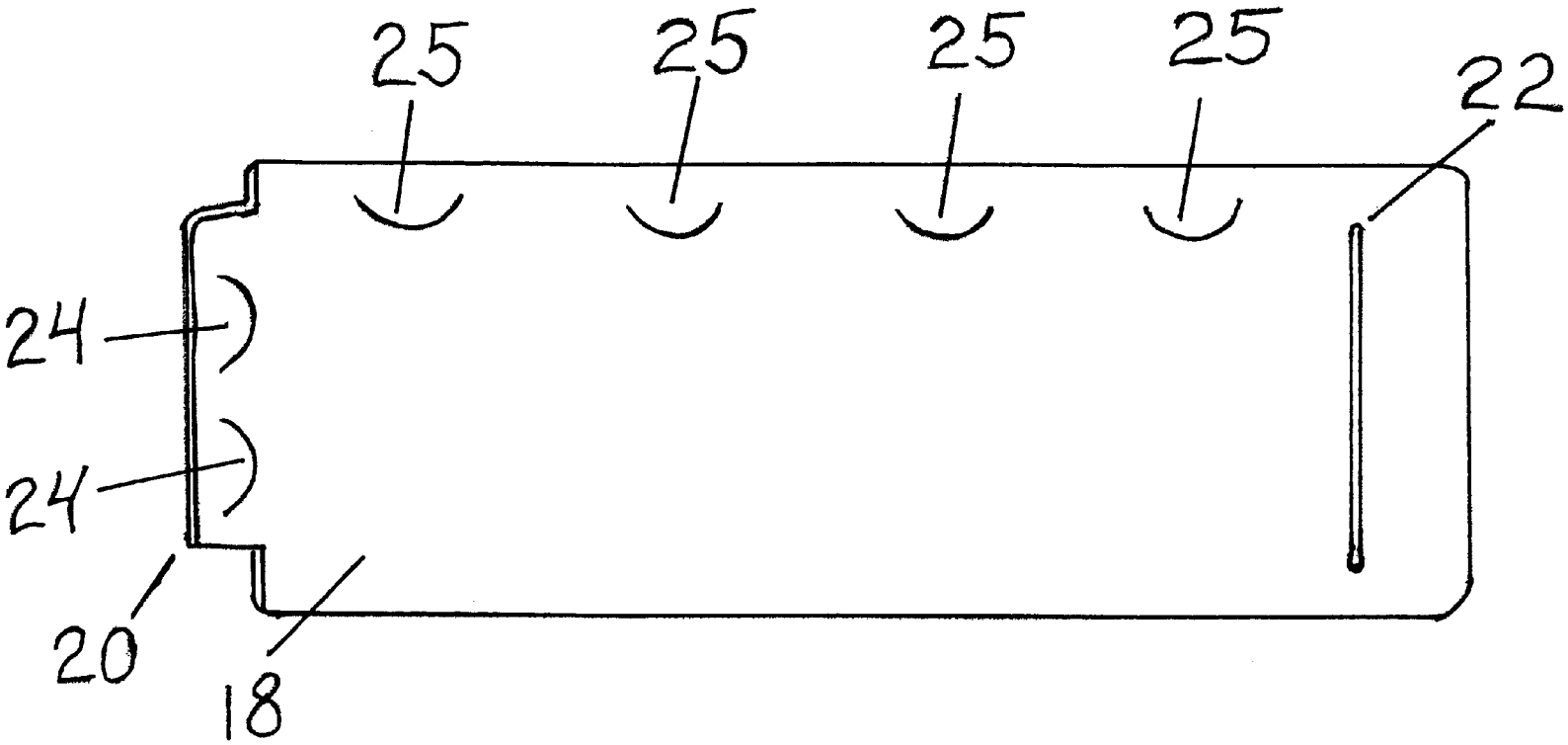
FIG. 1 shows a flattened sheet of flexible material with the cuts necessary to operation.

18. flexible sheet material
20. tab
22. slot
24. structural hooks
25. hooks for attaching foreign material
26. holes
28. insulation material
30. lid
32. slits
34. bands
36. weighted flexible tube
38. plastic bag

DESCRIPTION OF DRAWINGS - FIGS. 1 through 9

A typical embodiment of the present invention 18 is shown in FIG. 1 with the tab 20 being formed by cutting the excess material from two ends of the flexible sheet material 18, thereby creating a tab from the remaining material. On the tab are cut structural hooks 24 for a means to lock the invention to itself in a cylindrical shape. A slot 22 is cut in the end opposing the tab 20. Hooks for the attachment of foreign material 25 are cut along an edge perpendicular to the tab 20 end.

Figure 2:
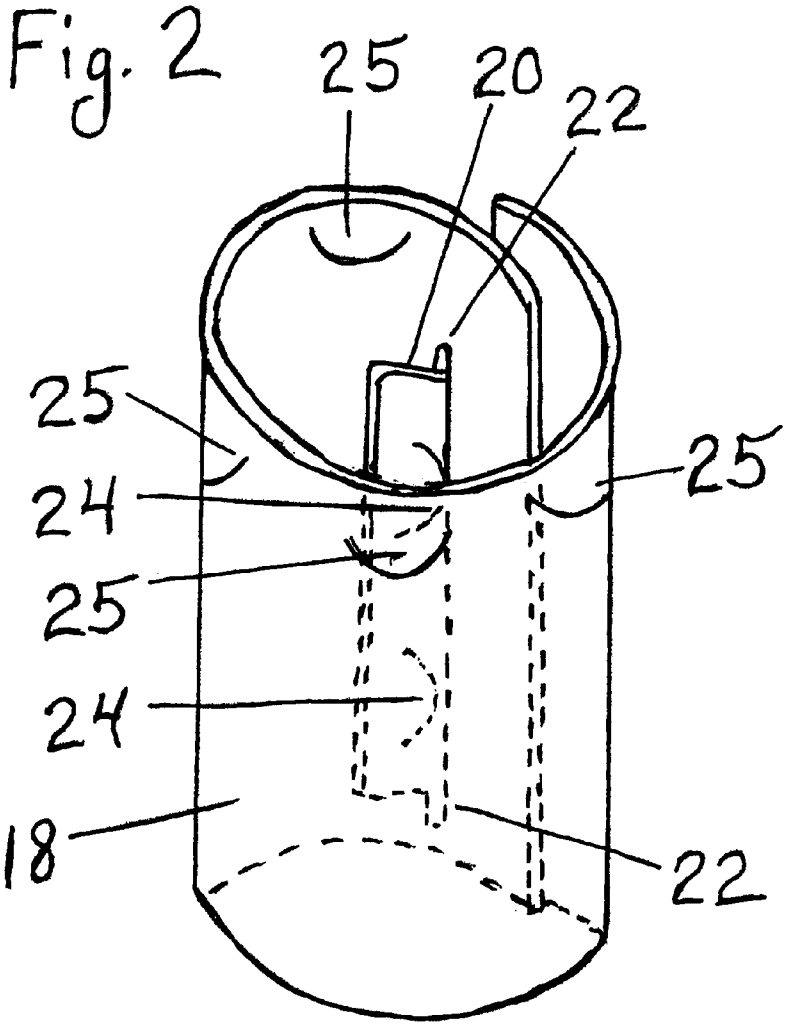
FIG. 2 shows the beginning procedure to lock into position, showing two opposite ends inside the cylinder.

FIG. 2 shows the flexible sheet material 18 being manipulated into a curve and positioned so that the tab 20 can be fed into the slot 22 so that both opposite ends of the sheet are inside the cylinder with the hooks 24 past the edge of the slot 22.

Figure 3:
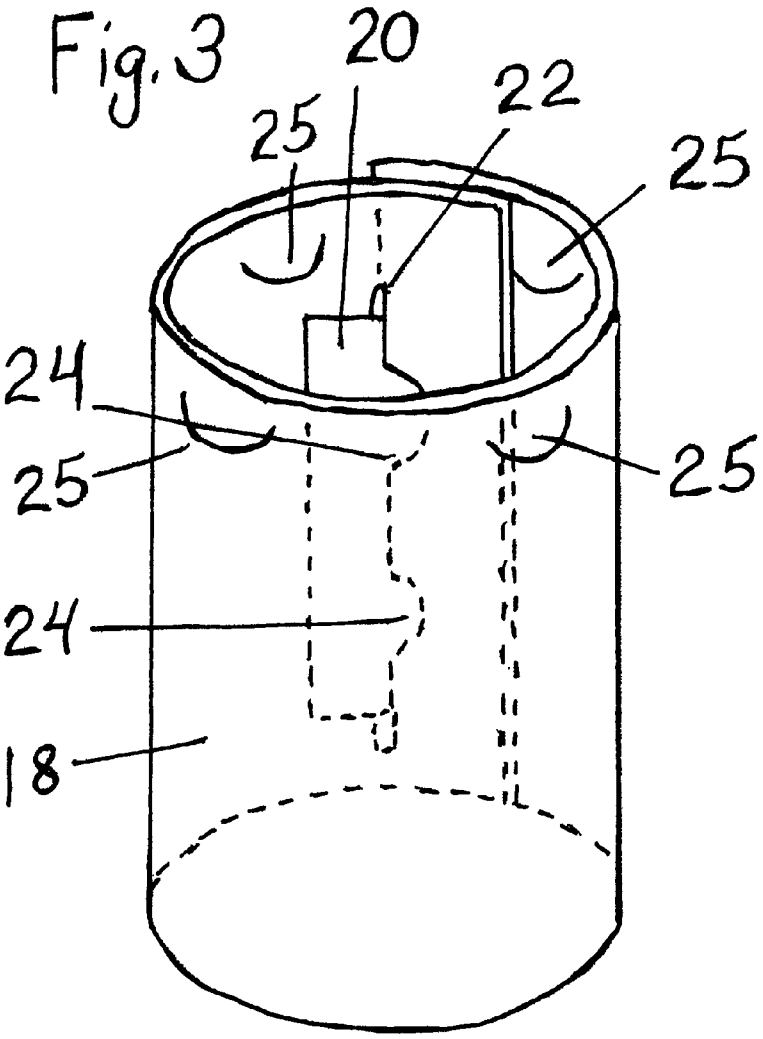
FIG. 3 shows a completely locked cylinder.

FIG. 3 shows the continuation of FIG. 2 with the tab 20 through the slot 22 but with the hooks 24 caught by the edge of the slot 22, thereby locking the cylinder into place.

Figure 4:
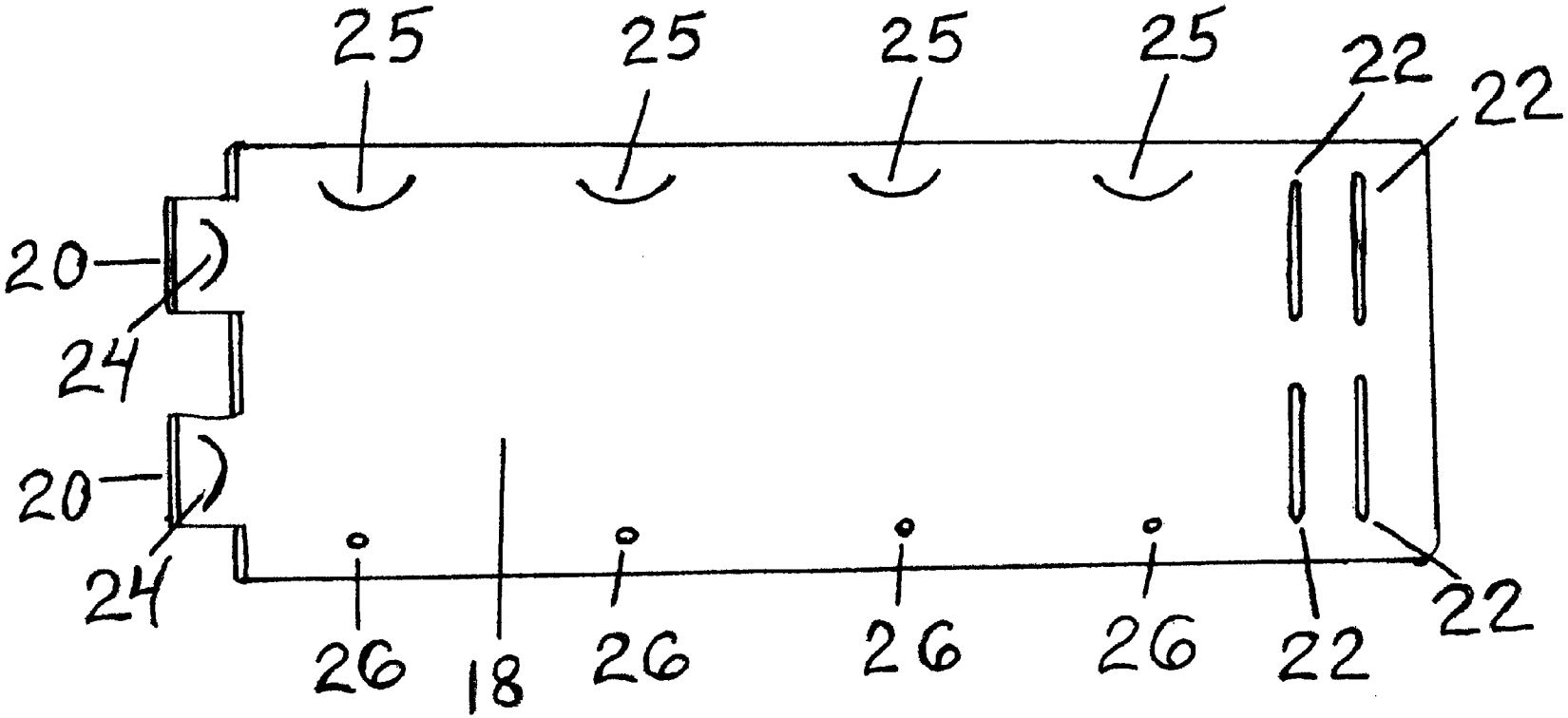
FIG. 4 shows a flattened sheet of flexible material with multiple tabs and slots and with holes close to the bottom edge.

FIG. 4 shows another embodiment of the present invention 18 with multiple tabs 20, with a structural fastening hook 24 on each tab 20, and multiple slots 22 cut in the end opposing tabs 20. The multiple slots 22 are for the purpose of accepting the tabs 20 and also allows for adjustability in the circumference of the present invention 18.

Figure 5:
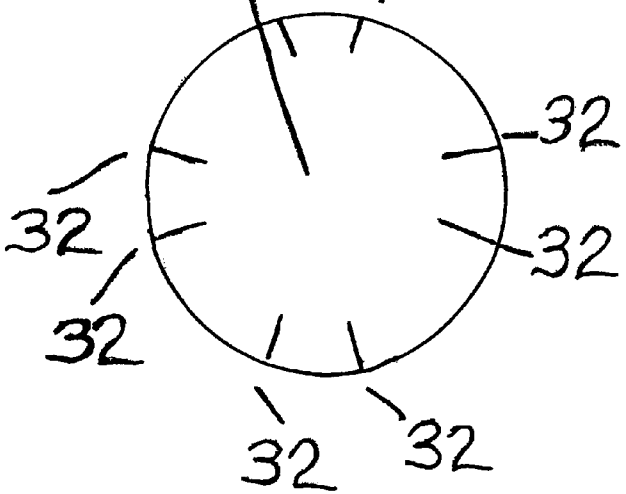
FIG. 5 shows a lid from sheet material with fastening slits.

FIG. 5 shows a lid 30 which, as an option to the present invention 18, is cut in slits 32 in multiples of two to correspond with the hooks 25.

Figure 6:
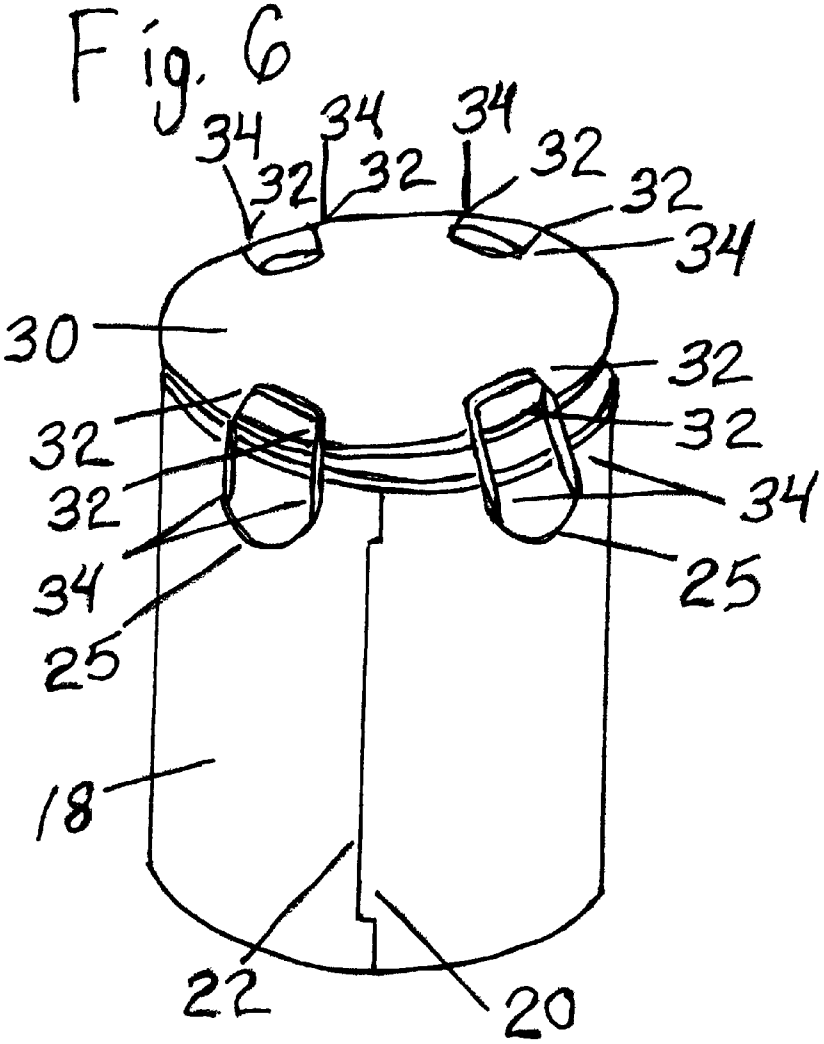
FIG. 6 shows the locked cylinder with the partial attachment of an optional lid.

FIG. 6 shows the flexible sheet material 18 formed and locked into a cylinder with the lid 30 attached to the hooks 25 by means of bands 34 hooked under the hooks 25 and through the slits 32 in the lid 30.

Figure 7:
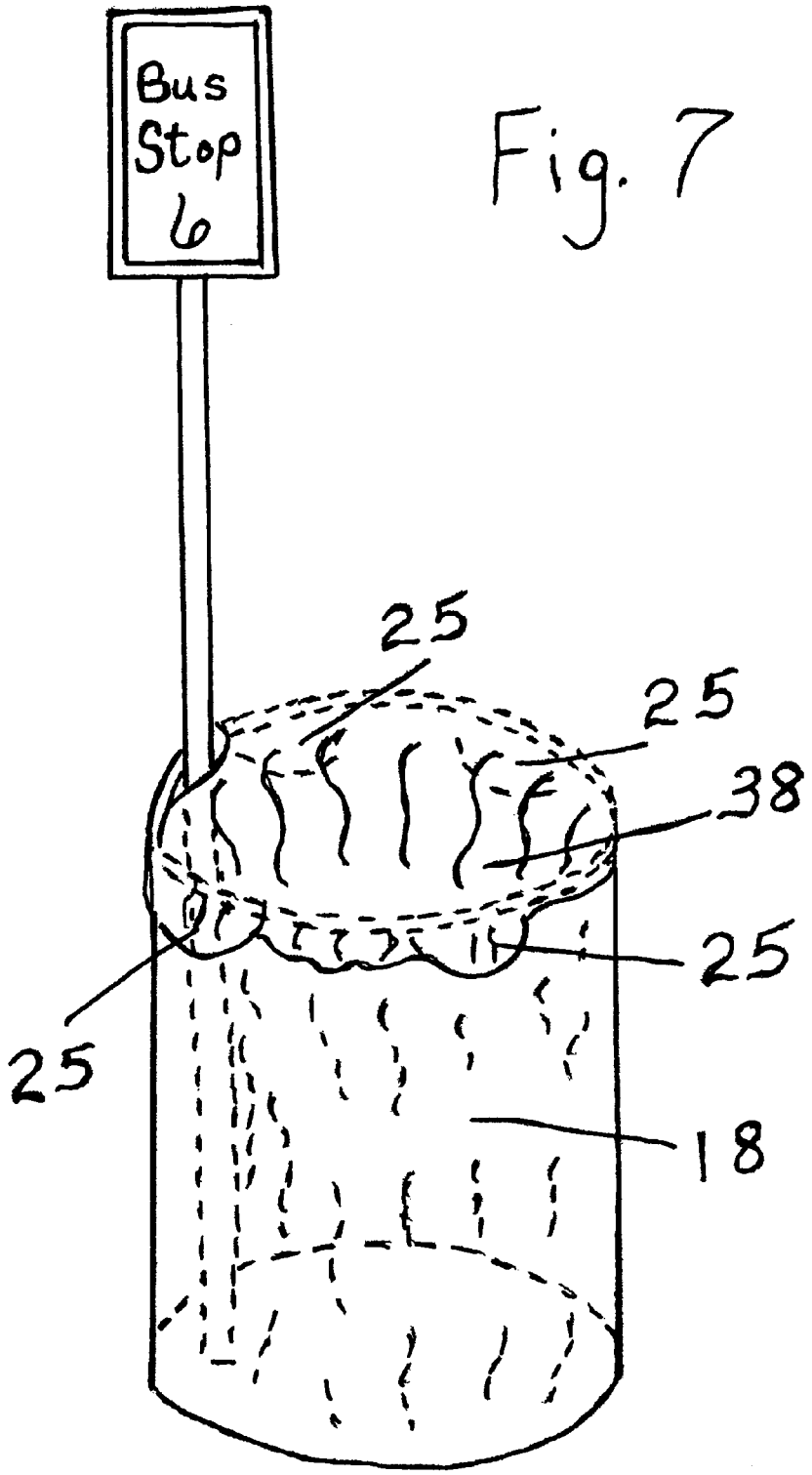
FIG. 7 shows placement of the locked cylinder around a post with a plastic bag inserted to show the procedure of attaching a bag while using the post to anchor the cylinder.

FIG. 7 shows an assembled and locked cylinder from flexible sheet material 18 which has been assembled around a post, before inserting a plastic bag 38 into the cylinder 18 and before attaching the plastic bag 38 to the hooks for attaching foreign material 25.

Figure 8:
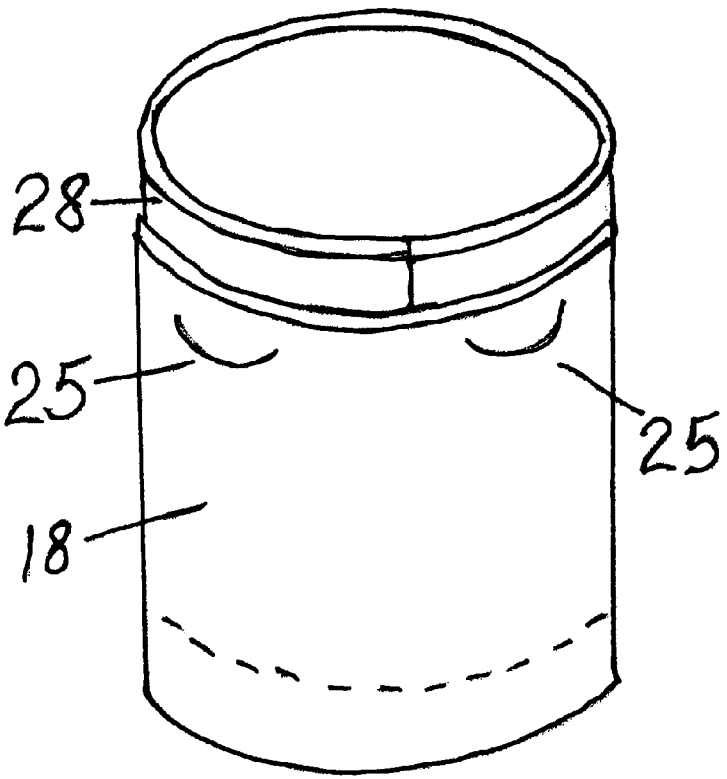
FIG. 8 shows partial insertion of insulation material.

FIG. 8 shows a partially inserted sleeve of insulation material 28 into the formed and locked cylinder 18 and before attaching a plastic bag 38 (not shown).

Figure 9:
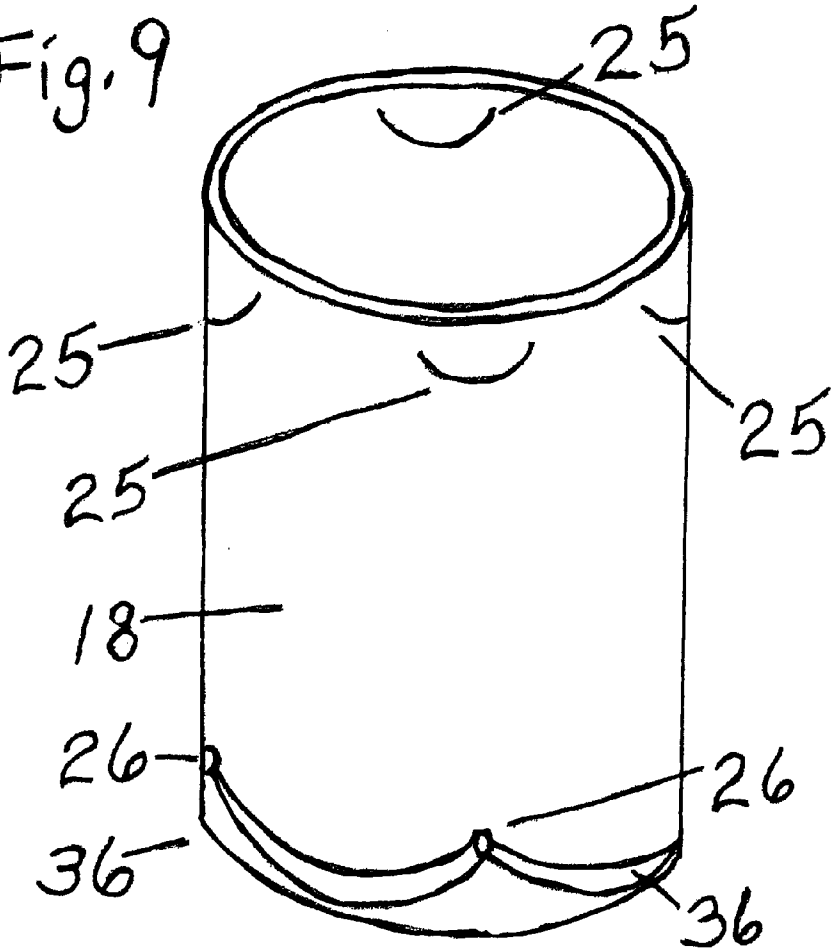
FIG. 9 shows the addition of an optional weighted flexible tube for anchoring against the wind.

FIG. 9 shows a formed and locked cylinder 18 without the attachment of a plastic bag 38 but with an optional weighted tube of flexible material 36 attached to holes 26.

SUMMARY OF THE INVENTION

This invention consists of one sheet of semi-rigid, weather impervious material with strategically placed cuts. The sheet can remain flat, when not in use, for shipping, warehousing and storage, particularly to the benefit of users of multiple units. To use, the sheet is manipulated into a curve, inserting the smaller end or tabs into a slot or slots at the opposing end of the sheet, past the fastening hooks, then pushing the cut ends of the fastening hooks toward the inside of the cylinder and allowing them to be caught by the edge of the slot or slots, thereby locking the cylinder into position. The top edge of the cylinder has downward pointing broad hooks which during use are for the purpose of attaching bags to enable free access to the opening of the bag during filling. As the bag is filled, pressure is increased upon the circumference of the cylinder causing added support and strength to the locking mechanism. Also as the bag is being filled, the hooks tighten upon the bag material therefore holding the bag even more securely. Once filled, the bag is unhooked from the cylinder and tied; the cylinder is then easily raised over the filled bag as static cling and suction have been reduced. If the user's project is finished, the cylinder can then be unlocked and restored to a flat condition. The cylinder is unlocked by slightly diminishing the circumference disengaging the hooks from the edge of the slot or slots. The hooks return to their original flat position for storage. This interlocking cylinder is to be manufactured in various sizes with the locking mechanism in each size. There are many purposes for the interlocking cylinder, including but not limited to: kitchen counter or restaurant uses, sizes to use for lawn maintenance, sizes to accommodate sand bagging operations, and industrial sizes for commercial use. This same interlocking design can be used for splash guards by contractors. Because of its design and ease of assembly, the cylinder would be valuable for horticulture, and in larger sizes, as tree protectors as the tool can be looped around a fixed object and fastened to itself. This is also valuable in looping around a fixed object, such as a sign or post, fastening the tool, then attaching a bag inside the tool with the bag looped around the post and again secured to the tool. When not secured around a fixed object, such as a post or tree, a temporary extraneous weighting device comprised of an elongated tube containing a substance of sufficient weight will stabilize the tool against adverse weather conditions. This same design can be utilized by using a hand held narrower version while maintaining the same arcuate cuts for the purpose of maintaining an opening in a plastic bag while picking up scattered debris. The extraneous, optional lid can be secured quickly and easily to the tool to protect seedlings from sudden adverse weather conditions such as frost. By adding an extraneous, temporary sleeve of closed cell, weather impervious, flexible sheeting to the interior circumference of the tool, then attaching a plastic bag, the present invention becomes a cooler to fill with ice and beverages for picnics, bar-b-ques or tailgate parties. The optional lid can be secured to the cylinder to protect seedlings. By adding foam insulating material and a plastic bag, the present invention becomes a cooler to fill with ice and beverages for picnics, bar-b-ques or tailgate parties.

We claim:

1. A multipurpose tool formed by looping and fastening around a fixed object, cut from flat, semi-rigid, weather impervious material which, upon manipulating into a curve, locks to itself by means of strategically placed cuts, with additional cuts through said material for the purpose of temporary attachment of extraneous devices, with said cuts comprising:

cuts to remove excess material by making perpendicular cuts in two corners of the material, thus forming a tab as a remaining narrower end of the material, and said tab of the material includes cuts through the material forming an arcuate hook with the terminal point ends of said hook pointing to a near edge of the tab in an even and parallel line to said edge of the tab, and the cuts include a slot cut through the material parallel to and near an opposing and of the material and opposite to the tab end and of sufficient length to accommodate insertion of the tab end through said slot, thereby causing both ends of the material to be inside said tool when manipulated into a curve and fastened, with the tab being of sufficient length to allow the hook to be caught by the slot, locking the tool into a loop, and with additional arcuate cuts forming hooks with terminal point ends toward an edge of the material perpendicular to the tab end and in a parallel line to temporarily attach extraneous devices, and with an extraneous weighing device comprising of an elongated tube containing a substance of sufficient weight to stabilize the tool by means of hooks inserted into holes in the tool to secure against adverse weather conditions.

2. The hooks of claim 1 are arcuate shaped as a preferred embodiment as arcuate hooks exert optimum pressure against a surface area when fastening the tool into a loop, and said arcuate hooks for fastening said extraneous devices are a preferred shape to minimize tearing or snagging during fastening of the temporary devices.

3. One extraneous device of the tool of claim 1 is a lid cut from weather impervious material with slits cut from the edge pointing inward in pairs at such intervals as to correspond with the terminal point ends of the arcuate hooks located along the edge of the material perpendicular to the tab end so that said lid is secured by placing bands under the hooks and continuing through said slits in the lid.

4. One temporary extraneous device of the tool of claim 1 is a sleeve of closed cell, weather impervious, flexible sheeting for insertion into the circumference of the tool sized to match the tool for use as insulation for use in protecting plants and as a temporary cooler.

* * * * *